United States Patent [19]

Nakamura et al.

[11] Patent Number: 4,825,807

[45] Date of Patent: May 2, 1989

[54] APPARATUS FOR APPLYING ANTI-STICKING AGENT ON ANNEALED ORIENTED ELECTRICAL SHEET STEEL IN COIL

[75] Inventors: Motoharu Nakamura; Takaaki Ohsawa; Hirokazu Haga; Akira Tanabe, all of Himeji, Japan

[73] Assignee: Nippon Steel Corporation, Tokyo, Japan

[21] Appl. No.: 218,300

[22] Filed: Jul. 13, 1988

[30] Foreign Application Priority Data

Nov. 5, 1987 [JP] Japan ..... 62-278311

[51] Int. Cl.[4] ..... B05C 11/00

[52] U.S. Cl. ..... 118/672; 118/709; 118/326; 118/630; 118/631; 118/634; 427/178

[58] Field of Search ..... 118/326, 672, 630, 631, 118/632, 633, 634, 709; 427/178

[56] References Cited

U.S. PATENT DOCUMENTS 4,086,872 5/1978 Pan ..... 118/630
4,488,505 12/1984 Schaming ..... 118/630

FOREIGN PATENT DOCUMENTS 39-12211 7/1939 Japan .
57-11393 3/1982 Japan .
60-128213 7/1985 Japan .

*Primary Examiner*—Shrive Beck
*Assistant Examiner*—Alain Bashore
*Attorney, Agent, or Firm*—Wenderoth, Lind & Ponack

[57] ABSTRACT

An apparatus for applying a powder of anti-sticking agent on a coil of oriented electrical steel strip formed on a coiler comprises a movable assembly moving closer to and away from the coiler, a stationary hood attached to the movable assembly and having slit-like suction ports provided along the walls thereof, one end of the suction ports opening toward the coiler, a duct-collecting duct connected to the slit-like suction ports of the stationary hood, movable hoods provided on the stationary hood to vertically open at the top and bottom of the open end of the stationary hood, and a group of electrostatic powder spray guns directed toward the coiler in the stationary hood in which they are disposed. The movable assembly recedes and the movable hoods open as the diameter of the coil increases so that a given space is always maintained between the surface of the coiled strip and the movable hoods. The slit-like suction ports draw out only such portion of the anti-sticking agent as is about to flow out through the small space left between the coil and hood.

6 Claims, 4 Drawing Sheets

APPARATUS FOR APPLYING ANTI-STICKING AGENT ON ANNEALED ORIENTED ELECTRICAL SHEET STEEL IN COIL

BACKGROUND OF THE INVENTION

1. Field of the Invention

This invention relates to an apparatus for electrostatically applying an anti-sticking agent on annealed oriented electrical sheet steel in coil.

2. Description of the Prior Art

Oriented electrical sheet steel made from hot-rolled strip by applying one, two or more cold reduction and annealing processes is further subjected, in coil form, to annealing at elevated temperatures to develop the crystals in (110) and [001] orientations. The strip to undergo this elevated-temperature annealing is coiled after an anti-sticking agent is applied on the exit side of the continuous annealing furnace to prevent the occurrence of undesirable seizure between individual wraps of the coil.

Magnesia, alumina and some other refractories have been used as the anti-sticking agent. Aqueous suspensions of such refractories are applied and dried on the surface of the strip. Especially magnesia has been in popular use as it forms a glassy film consisting essentially of forsterite ($2MgO.SiO_2$) reacting at high temperatures with a layer of scale, consisting principally of silica, formed on the surface of the strip.

When magnesia is suspended in water, part of it is hydrated into magnesium hydroxide, which, in the subsequent annealing process, gets decomposed and excessively oxidizes the surface of the strip, thereby damaging the magnetic properties of the steel and the uniformity of the glassy film.

To overcome such disadvantages, the methods disclosed in the Japanese Patent Public Disclosure Nos. 12211 of 1964 and 11393 of 1982 electrostatically apply powders of anti-sticking agent on the surface of steel strip to be annealed. The method of the Japanese Patent Public Disclosure No. 12211 of 1964 applied a powder of anti-sticking agent on the surface of steel strip by introducing the powder into a space between the strip and an electrode discharging a positive corona. The method of the Japanese Patent Public Disclosure No. 11393 of 1982, on the other hand, applies a small quantity of slurry consisting principally of magnesium oxide on the surface of strip in order to assure the forming of a good glassy film. Then, an electrically charged powder of anti-sticking agent is applied on the dried undercoat on the oppositely charged strip of oriented electrical steel.

Another method disclosed in the Japanese Provisional Patent Publication No. 128213 of 1985 electrostatically applies a charged powder of anti-sticking agent on the surface of oppositely charged strip of oriented electrical steel using a spray gun. This method applies the charged powder to the under side of the strip at a point closer to the coiler than the roll on the entry side thereof. Considering space limitations and other factors, the gun 4 shown in FIG. 1 of the same publication is installed in the optimum position. But the specification states that the object of the invention can be achieved even if the gun is not placed in that specific position but in other position between points A and B. The specification also says that the powder spray gun and dust-collector (not shown) should preferably be movable with a change (i.e., an increase) in the diameter of a coil.

However, the Japanese Provisional Patent Publication No. 128213 of 1985 shows neither any concrete mechanism by which the spray gun and dust-collector follow up a change in the coil diameter nor the best type of such dust-collector. An improperly designed dust-collector may draw out the powder of anti-sticking agent that is flying toward the strip, thus materially lowering the rate of powder adhesion of the strip.

SUMMARY OF THE INVENTION

The object of this invention is to provide means for electrostatically applying a powder of anti-sticking agent on strip of oriented electrical steel that is capable of efficient powder application and effective dust collection.

An apparatus for applying anti-sticking agent on annealed oriented electrical sheet steel in coil of this invention comprises (a) an assembly capable of moving close to and away from the coiler, (b) a stationary hood attached to the movable assembly and having slit-like suction ports opening on the coiler side provided along the walls thereof, (c) a dust-collecting duct connected to the slit-like suction ports of the stationary hood, (d) movable hoods attached to the stationary hood and adapted to move up and down at the top and bottom of the open end of the stationary hood, (e) a group of electro-static spray guns provided in the stationary hood and directed toward the coiler, and (f) a drive unit that moves the movable assembly away from the coiler and opens the movable hoods as the diameter of a coil of electrical steel strip on the coiler increases.

As more strip is taken up by the coiler, not only the coil diameter but also the radius of curvature of the coil on which the anti-sticking agent is applied increases. As the coil diameter thus changes, the group of electrostatic spray guns are moved backward so that they are always away from the coil at a distance appropriate for the application of the anti-sticking agent. At the same time, the movable hoods are adjusted so that a given small clearance is always kept between the surface of the strip and the edge of the movable hoods. Meanwhile, the slit-like suction ports, provided along the walls of the stationary hood, do not draw out the powder of the anti-sticking agent flying from the elec-trostatic spray guns to the surface of the strip. The slit-like suction ports draw out only such powder as have reached the surface of the strip but have failed to adhere thereto or bounced thereoff. Such powder will escape to the outside of the hoods (both stationary and movable) through said small clearance if it were not for the slit-like suction ports. The provision of the slit-like suction ports prevents the undesirable outflow of the anti-sticking agent that may cause a serious environmental pollution problem.

DESCRIPTION OF THE PREFERRED EMBODIMENTS

Now details of a preferred embodiment of this invention will be described by reference to accompanying drawings.

Figure 1:
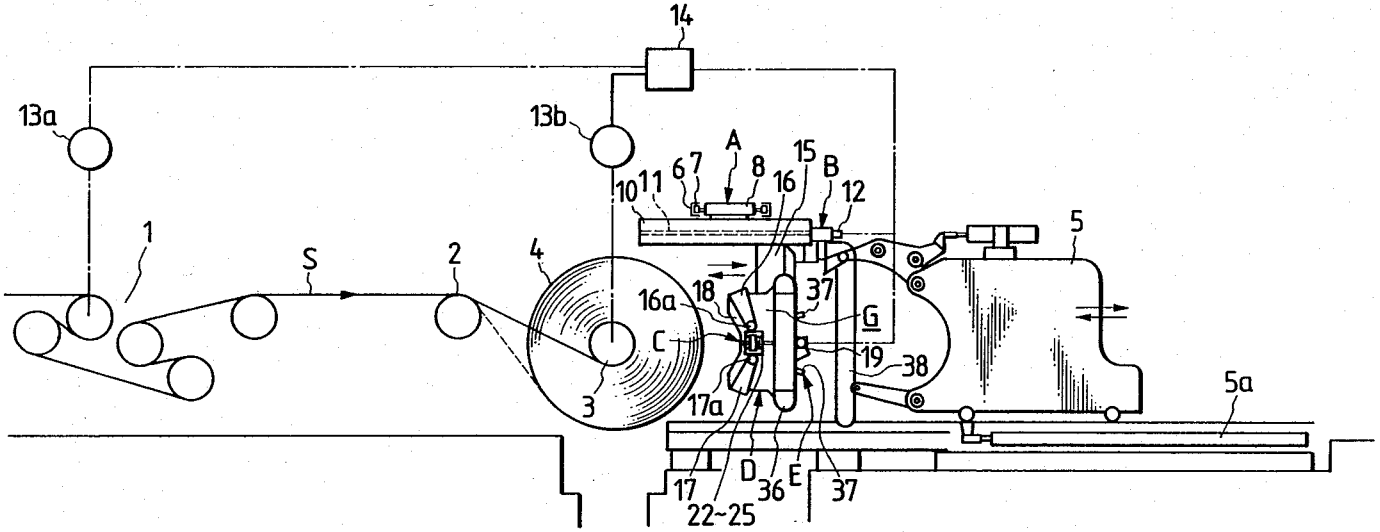
FIG. 1 is a side elevation showing an apparatus for applying anti-sticking agent on annealed oriented electrical sheet steel in coil of this invention, together with a coiler.

FIG. 1 shows an apparatus for applying anti-sticking agent on annealed oriented electrical sheet steel in coil of this invention, together with a coiler. A coiler 3 winds up strip of oriented electrical steel S, which has passed through a bridle 1 and over a deflector roll 2 and is to be applied with a powder of anti-sticking agent, into a coil 4. The bridle 3 provides an appropriate amount of tension to the strip S to be wound up by the coiler 3. A belt wrapper 5 is disposed downstream in such a manner as to face the coiler 3. The belt wrapper 5 wraps the leading end of the strip S around the mandrel of the coiler 3 before starting the winding of the coil 4.

The anti-sticking agent application apparatus is provided at the right of the coiler 3 in the figure. This apparatus consists essentially of a retracting mechanism A to bring the whole apparatus into and out of the application line, a mechanism B to move a gun-hood assembly G back and forth according to a change in the diameter of the coil 4, a mechanism C to open and close movable hoods according to the same change in the coil diameter, a dust-collecting mechanism D comprising a hood with slit-like suction ports, and an electrostatic powder application unit E. The gun-hood assembly G comprises a movable frame 15 and the movable hoods open-close mechanism C, dust-collecting mechanism D and electrostatic powder application unit E mounted on the movable frame 15.

Figure 2:
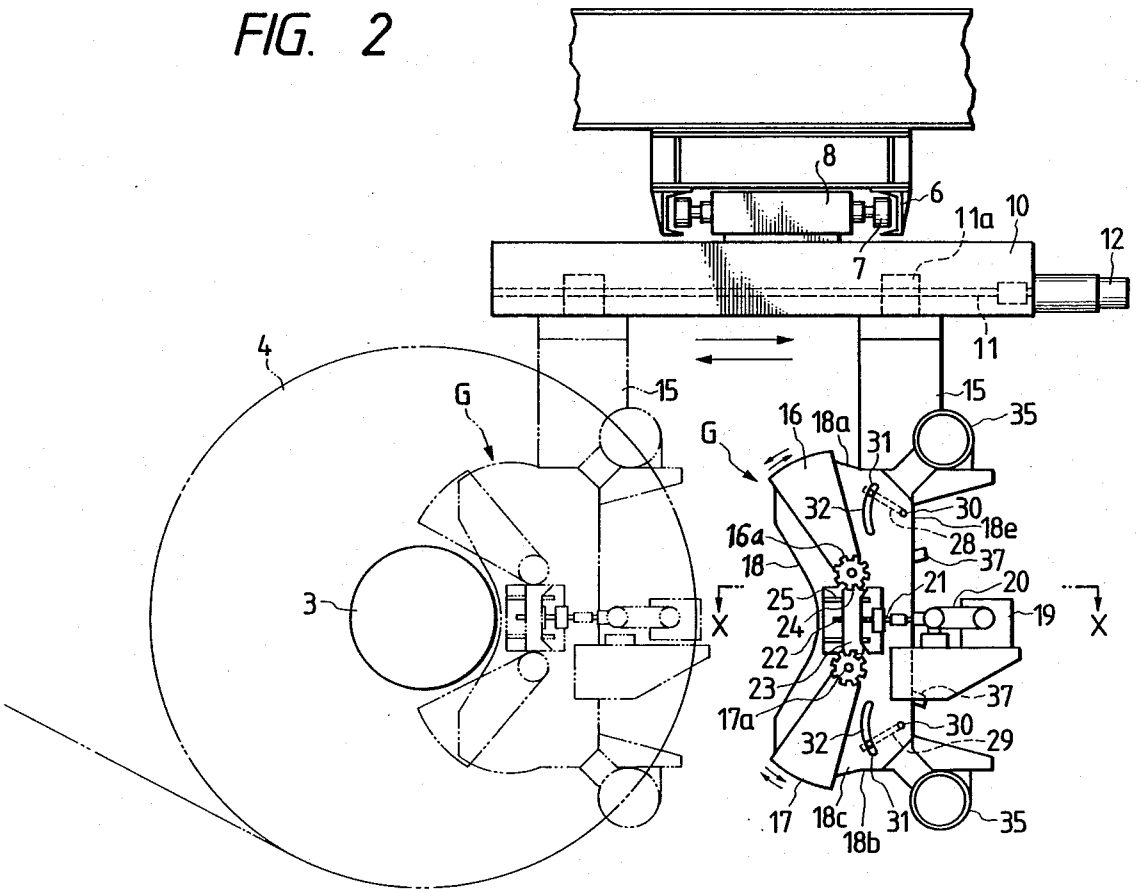
FIG. 2 is a side elevation enlarging a primary portion of the applying apparatus shown in FIG. 1.
Figure 5:
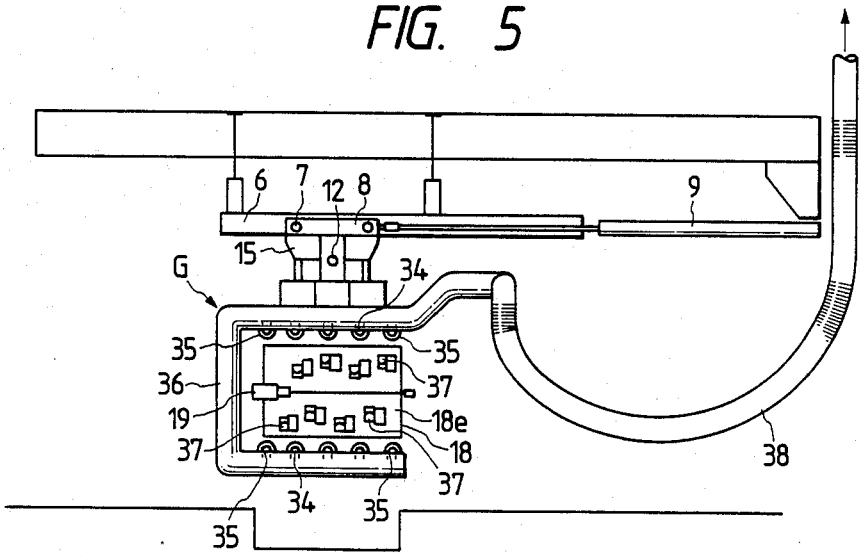
FIG. 5 is a rear view of the hood.

Retracting mechanism A:

As shown in FIGS. 1, 2 and 5, the retracting mechanism A comprises rollers 7 running along rails 6 attached to the ceiling to extend parallel to the mandrel of the coiler 3. The rollers 7 carry a traverser that is driven by a hydraulic cylinder 9. A beam 10 extending at right angles to the axis of the coiler 3 is attached to the traverser 8. The movable frame 15 suspends from the beam 10. The movable frame 15, i.e., the gun-hood assembly G, moves toward and away from the coiler 3 by means of a screw 11 to adjust the space between itself and the coil 4 as shown in FIG. 2.

Gun-hood assembly reciprocating mechanism B:

The reciprocating mechanism B to move the gun-hood assembly G according to a change in the diameter of the coil 4 comprises the screw 11 rotatably fitted in the beam 10 as shown in FIGS. 1, 2 and 5. An AC servo motor 12 is connected to the rear end of the screw 11. An internally threaded slider 11*a* is fitted over the screw 11. The movable frame 15 hangs from the slider 11a. The AC servo motor 12 turns the screw 11, thereby moving back and forth the movable frame 15. A control unit 14 controls the operation of the AC servo motor 12 on the basis of the diameter of the coil 4 that is derived from the ratio between the numbers of rotations of the bridle 1 and coiler 3 determined by pulse generators 13*a* and 13*b*, known strip thickness and other data. The control unit 14 contains a general-purpose microcomputer of the known type that performs the above computation and outputs an operational signal to the AC servo motor 12.

Figure 3:
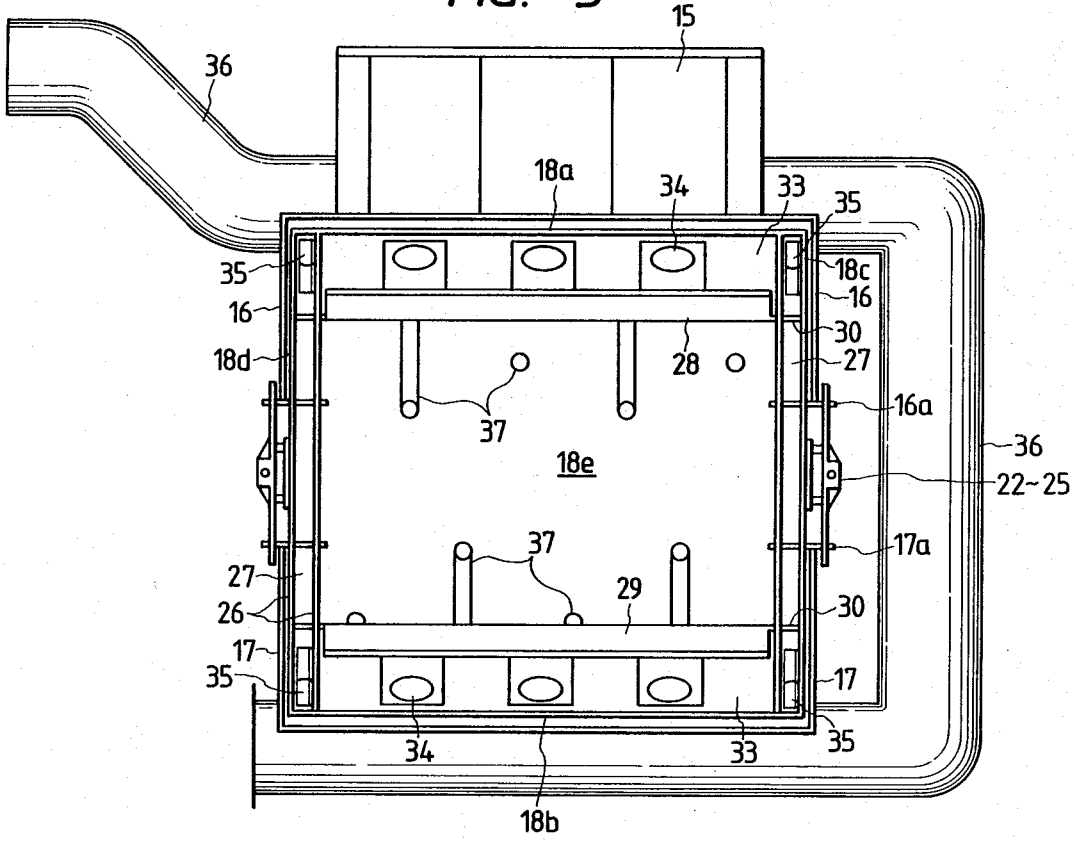
FIG. 3 is the front view of the hood of the same applying apparatus viewed from the coil side.
Figure 4:
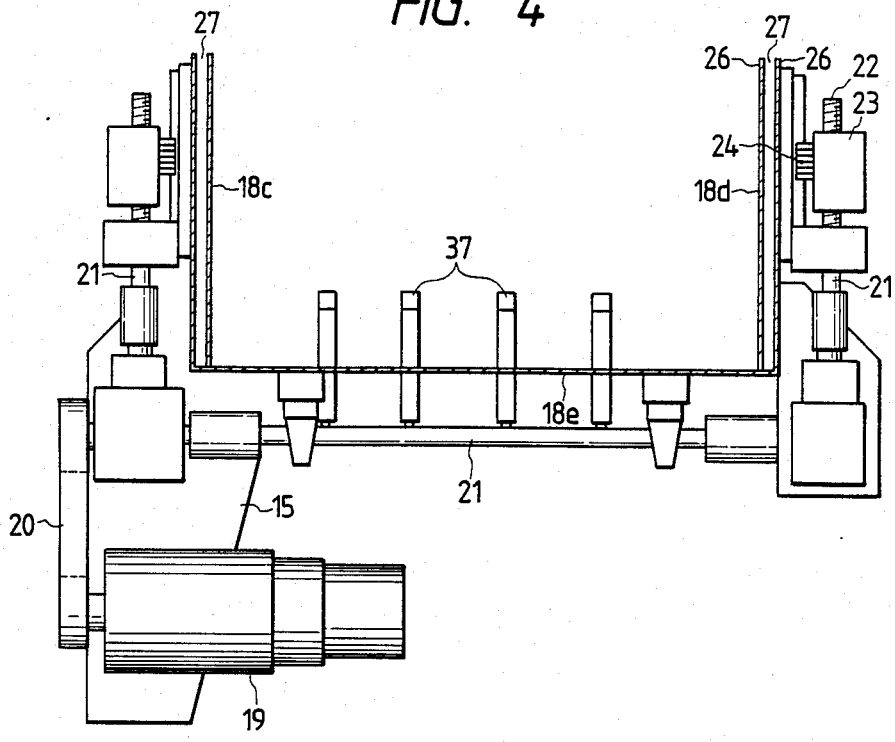
FIG. 4 is a cross-sectional view taken along the line X—X in FIG. 2.

Movable hood open-close mechanism C:

The mechanism C to open and close, according to a change in the coil diameter, top and bottom movable hoods 16 and 17 provided on the outside of a stationary hood 18, as shown in FIGS. 1, 2 and 3, comprises an AC servo motor 19 mounted on the movable frame 15 at the back of the stationary hood 18 as shown in FIGS. 1, 2 and 4. The rotation of the AC servo motor 19 is transmitted to a rotating shaft 21 by means of a belt 20. An internally threaded slider 23 having racks 24 cut at the top and bottom ends thereof is fitted over a threaded portion 22 at the front end of the rotating shaft 21 as shown in FIG. 2. Guided by linear-motion guides 25, the slider 23 moves back and forth with the rotating shaft 21 as the rotating shaft 21 rotates. Reference characters 16*a* and 17*a* designate pinions engaged with the racks 24. The movable hoods 16 and 17 are attached to the pinions 16*a* and 17*a*. Thus, the AC servo motor 19 opens and closes the top and bottom movable hoods 16 and 17. The control unit 14 controls the operation of the AC servo motor 19, in the same way as with the AC servo motor 12, to adjust the opening of the movable hoods 16 and 17 on the basis of a change in the diameter of the coil 4, as shown in FIG. 1. A dot-dash line in FIG. 2 shows the gun-hood assembly G brought closer to the coiler 3.

Dust-collecting mechanism D:

The dust-collecting mechanism D comprises a stationary hood 18 having slit-like suction ports. The stationary hood 18 is defined by top and bottom walls 18*a* and 18*b*, side walls 18*c* and 18*d*, and a rear wall 18*e*, as shown in FIGS. 1 to 4. Each of the side walls 18*c* and 18*d* has a double structure 26 as shown in FIGS. 3 and 4. The front end (i.e., the end facing the coil 4) of the double-structure side walls 18*c* and 18*d* is opened to form a slit-like suction port 27. Also, the front edge of the stationary hood 18 curved substantially in conformity with the curved profile of the mandrel of the coiler 3. Movable plates 28 and 29 extending across the width of the stationary hood 18 are provided below the top wall 18a and above the bottom wall 18*b*, respectively, as shown in FIGS. 2 and 3. As illustrated, the rear end of the movable plates 28 and 29 is rotatable on a pivot 30. The movable plates 28 and 29 turn as a pin 31 attached thereto is moved along a guide slot 32. A space between the top wall 18*a* and movable plate 28 and a space between the bottom wall 18*b* and movable plate 29 form slit-like suction ports 33. The open area of the slit-like suction ports 33 is adjusted by turning the movable plates 28 and 29. Fine adjustment of the sucking force of the suction ports 33 can be achieved by the adjustment of the open area thereof. The suction ports 33 may be of the structure analogous to that of the suction ports 27.

The movable hoods 16 and 17 are pivotally supported by the side walls 18*c* and 18*d* so as to be movable back and forth.

In FIGS. 2, 3 and 5, reference numeral 34 designates an exit port from which powder of magnesia sucked through the suction ports 33 is discharged outside, while reference numeral 35 denotes another exit port from which powder of magnesia sucked through the suction ports 27 is discharged outside. The exit ports 34 and 35 are connected to a common exhaust duct 36. Reference numeral 38 designates a flexible exhaust hose. The flexible hose 38 is connected to an exhaust fan (not shown).

Electrostatic powder application unit E:

The electrostatic powder application unit E, comprising a total of eight electrostatic spray guns 37, four disposed on top of four, is inserted into the stationary hood 18 through the rear wall 18e thereof. A powder feeder (not shown) supplies powder of magnesia under pressure, which is an anti-sticking agent, to the electrostatic spray guns 37. With a DC current of high voltage applied, the tip of the spray guns 37 discharge electric coronas, whereby the powder of magnesia is charged when the powder passes through such coronas. Advancing in the direction of a line of electric force due to the potential difference between the tip of the spray guns and the coil, the charged powder of magnesia reaches and adheres to the surface of the strip.

Process of Powder Application:

Before starting the winding of the coil 4, the hydraulic cylinder 9 is operated to retract the gun-hood assembly G out of the powder application line. Next, the belt wrapper 5 is brought closer to the coiler 3 by means of the hydraulic cylinder 5*a*. With the help of the belt wrapper 5, the leading end of the electrical steel strip S is wrapped around the coiler 3 by the known method. When the wrapping is completed, the hydraulic cylinder 5*a* is operated again to withdraw the belt wrapper 5.

Subsequently, the hydraulic cylinder is operated again to push the gun-hood assembly G into the powder application line. By means of the AC servo motor 12, the gun-hood assembly G is moved closer to the coiler 3, as indicated by the dot-dash line in FIG. 2, so that a given space is maintained between the coiler 3 and the electro-static spray guns 37. The portion of the coil on which the powder of anti-sticking agent is to be applied is covered by the stationary hood 18. The AC servo motor 19 is operated to close the movable hoods 16 and 17 until a given small space is left between the movable hoods 16 and 17 and the coiler 3. As the coiler 3 begins to wind up the strip to form the coil 4, the electrostatic spray guns 37, in conjunction with a dust-collector (not shown), states the electrostatic application of the magnesia powder onto the surface of the coil 4. Then, the control unit shown in FIG. 1 controls the operation of the AC servo motors 12 and 19 to withdraw the gun-hood assembly G and open the movable hoods 16 and 17 as the diameter of the coil 4 increases so that the given space between the coil 4 and the spray guns 37 is always maintained. The charged powder of magnesia ejected from the spray guns 37 adhere to the surface of the oppositely charged coil 4. Such powder as has failed to adhere is sucked away by the slit-like suction ports 33 at the top and bottom and the slit-like suction ports 27 on both sides and then discharged outside through the exhaust duct 36.

A feature of this invention lies in the combination of the stationary hood 18 with the movable hoods 16 and 17. By further opening the movable hoods 16 and 17 with an increase in the diameter of the coil 4, the desired small space between the coil 4 and the movable hoods 16 and 17 is always maintained. This feature always assures efficient dust collection.

Another feature of this invention lies in the dust-collecting mechanism having the slit-like suction ports 27 and 33. The common method to collect dust from the whole area within the hood will catch not only unwanted dust but also the magnesia powder flying from the electrostatic spray guns to the coil, thereby seriously impairing the powder application efficiency. The dust-collecting mechanism of our invention is based on an idea to achieve a remarkable increase in the powder application efficiency by collecting only such portion of the magnesia powder as is about to flow out through the small space between the coil and the hood. In the apparatus of this invention, unwanted dust is drawn out through the slit-like suction ports 27 and 33 provided along the stationary hood surrounding the electrostatic spray guns. The magnesia powder flying from the guns to the coil remains unaffected by the suction force.

This invention should not be limited to the preferred embodiment just described.

For example, the use of an optical system readily permits direct detection of an increase in the coil diameter. The slit-like suction ports 33 at the top and bottom of the stationary hood also may be designed like the double structure 26 of the side walls 18*c* and 18*d*. The slit-like suction ports 27 provided along the side walls 18c and 18d also may be designed to be capable of adjusting the area of opening like the top and bottom slit-like suction ports 33. If the coiler 3 is of the type having no belt wrapper 5, the retracting mechanism A to bring the whole apparatus in and out of the application line may be omitted.

What is claimed is:

1. An apparatus for applying a powder of anti-sticking agent on a coil of oriented electrical steel strip provided next to a coiler which comprises:

(a) an assembly capable of moving close to and away from the coiler;

(b) a stationary hood attached to the movable assembly having slit-like suction ports opening on the coiler side provided along the walls thereof;

(c) a dust-collecting duct connected to the slit-like suction ports of the stationary hood;

(d) movable hoods attached to the stationary hood and adapted to move up and down at the top and bottom of the open end of the stationary hood:

(e) a group of electrostatic spray guns provided in the stationary hood and directed toward the coiler; and (f) drive units that move the movable assembly away from the coiler and open the movable hoods as the diameter of the coil of electrical steel strip of the coiler increases.

2. An apparatus for applying a powder of anti-sticking agent on a coil of oriented electrical steel strip provided next to a coiler to make the coil with the axis horizontal which comprises:

(a) a frame capable of moving close to and away from the coiler;

(b) a box-shaped stationary hood having from the movable frame and opening on the coiler side, the stationary hood having slit-like top, bottom and side suction ports opening on the coiler side provided along the top, bottom and side walls thereof;

(c) a dust-collecting duct connected to the slit-like suction port of the stationary hood;

(d) a pair of vertically movable hoods attached to the stationary hood and adapted to open and shut the upper and lower portions of the opening of the stationary hood;

(e) a group of electrostatic spray guns provided on the rear wall of the stationary hood and directed toward the coiler;

(f) means to move the movable frame back and forth;

(g) means to open and close the movable hoods; and (h) control means to detect the diameter of the coil being formed on the coiler and control the operation of the movable frame reciprocating and opening means so that the movable frame recedes and the movable hoods open with an increase in the coil diameter.

3. An apparatus according to claim 2, in which the movable frame is attached to a traverser movable perpendicularly to the direction in which the movable frame moves closer to and away from the coiler, the traverser being adapted to move in such a manner as to bring the movable frame into and out of the powder application line.

4. An apparatus according to claim 2, in which the movable frame moving means comprises a threaded rod extending in the direction in which the movable frame moves back and forth and a slider engaged with the threaded rod and carrying the movable frame attached thereto.

5. An apparatus according to claim 2, in which the movable frame opening means comprises a servo motor attached to the movable frame, a threaded rod rotated by the servo motor through transmissions attached to the movable frame, linear motion guides attached to the stationary hood, a slider engaged with the threaded rod, having racks and moving closer to and away from the coiler guided by the linear motion guides, and pinions provided on the supporting shafts of the movable hoods and engaged with the racks, the movable hoods being opened and closed by the threaded rod rotated by the servo motor.

6. An apparatus according to claim 2, in which the control means has means to detect the number of rotation of the coiler and a bridle provided on the entry side of the coiler to pass the strip of electrical steel therethrough.

* * * * *